United States Patent [19]

Tanabe

[11] Patent Number: 4,629,850

[45] Date of Patent: Dec. 16, 1986

[54] HEATING APPARATUS HAVING A SELECTIVELY MOVABLE HEATER

[75] Inventor: Takeshi Tanabe, HigashiOsaka, Japan

[73] Assignee: Sharp Kabushiki Kaisha, Osaka, Japan

[21] Appl. No.: 781,977

[22] Filed: Sep. 30, 1985

[30] Foreign Application Priority Data

Oct. 5, 1984 [JP] Japan ..... 59-151654[U]

[51] Int. Cl.[4] ..... H05B 6/64

[52] U.S. Cl. ..... 219/10.55 B; 219/10.55 E; 219/10.55 M; 219/404; 99/325

[58] Field of Search ..... 219/10.55 B, 10.55 E, 219/10.55 R, 10.55 M, 404, 402, 403, 411, 413; 126/339, 337 A, 332; 99/325

[56] References Cited

U.S. PATENT DOCUMENTS 4,255,639 3/1981 Kawabata et al. ..... 219/10.55 B
4,357,513 11/1982 Kawata et al. ..... 219/10.55 B

FOREIGN PATENT DOCUMENTS 2106374 4/1983 United Kingdom ..... 219/10.55 B

*Primary Examiner*—Philip H. Leung
*Attorney, Agent, or Firm*—Birch, Stewart, Kolasch & Birch

[57] ABSTRACT

A heating apparatus includes a selectively movable heater for heating an object, a detection circuit for detecting the position of the heater, a memory for storing a signal from the detecting circuit, a control circuit for controlling the input and the output of the memory, and a heater moving device for selectively moving the heater so as to set the heater at a suitable position based on the output of the memory.

9 Claims, 5 Drawing Figures

HEATING APPARATUS HAVING A SELECTIVELY MOVABLE HEATER

BACKGROUND OF THE INVENTION

The present invention relates to a heating apparatus and, more particularly, to a heating apparatus having a movable heater which automatically enables a selection of a suitable heating position of the heater for a grill heating operation.

In a combined microwave oven and grill oven in an art related to the present invention, before grill heating is started, a foodstuff to be heated is placed into a heating oven chamber, and a grill heater must be manually positioned rear the foodstuff. After the setting of the heater is completed, a heating key is pressed to start the grill heating. In this case, the user must remain the setting position of the heater.

To obtain good cooking completion, it may be difficult to accurately set the heater at the position in relation with the foodstuff every time. The heated foodstuff is therefore not beautifully browned.

Even when cooking is satisfactorily completed by suitably selecting the heater position for grill heating, the heating position of the heater must be manually selected to repeat the cooking. Therefore,the heating position of the heater which was set in the previous cooking to obtain a beautiful brown is difficult to reselect. Therefore, the satisfactory cooking cannot be repeatedly obtained by the grill heating.

Accordingly, it is desired that a novel heating apparatus having a selectively movable heater be provided with an apparatus to automatically set the heating position of a heater for the grill cooking.

SUMMARY OF THE INVENTION

Accordingly, it is an object of the present invention to provide a heating apparatus having a selectively moveable heater which can automatically set the heating position of a heater of a grill cooking.

It is another object of the present invention to provide a combined microwave oven and grill oven which automatically selects the stored heating position when the same menu is selected after the position data of the heater has been stored once in relation with the menu.

Other objects and furhter scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

To achieve the above objects, according to an embodiment of the present invention, a heating apparatus comprises selectively movable heater means for heating an object, detection means for detecting the position of said heater means, memory means for storing a signal from said detecting means, control means for controlling the input and the output of said memory means, and heater moving means for selectively moving the heater means so as to set the heater means at a suitable position based on the output of the memory means.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE EMBODIMENTS

A preferred embodiment of the present invention is now described in terms of a microwave oven although not limited to the microwave oven. The microwave oven has selectively movable heater of the present invention as described with reference to FIGS. 1 through 5.

A microwave oven of the present invention has three heating functions as follows:

1. Microwave Heating:

A foodstuff to be heated is heated by high frequency microwaves.

2. Oven Heating:

A foodstuff to be heated is heated by a convection heating. In this case, heat of a heater is circulated in the heating chamber by a fan.

3. Grill Heating:

A foodstuff to be heated is heated by both high frequency microwaves and heat of the heater. The heated foodstuff is beatifully browned by the heat of the heater.

Figure 1:
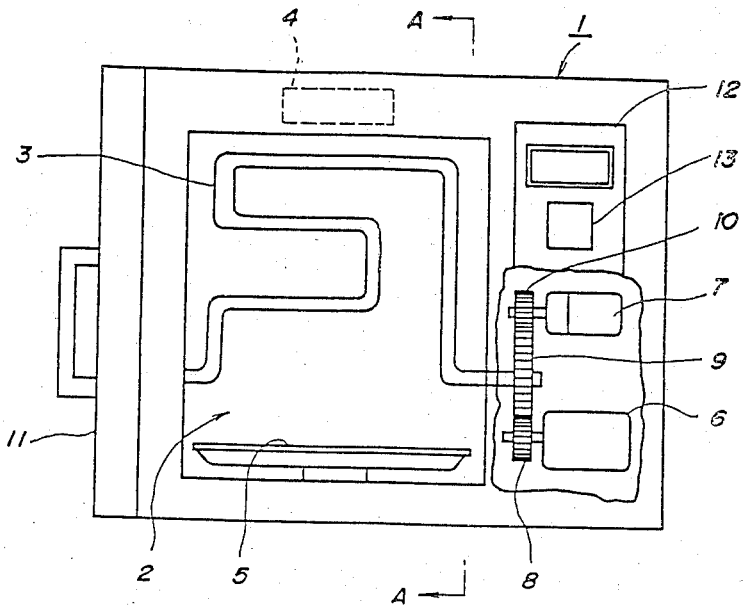
FIG. 1 shows a view of a microwave oven having a movable heater according to an embodiment of the present invention.

FIG. 1 shows a front view of a microwave oven having a selectively movable heater according to an embodiment of the present invention when the front door of the microwave oven is opened. A microwave oven 1 according to an embodiment of the present invention comprises a heating chamber 2, a selectively movable sheath heater 3 for a grill heating and a convection heating, a magnetron 4 for a high frequency microwave heating, a turntable 5 for carrying a foodstuff to be cooked, a direct current (DC) motor 6 for driving and rotating the sheath heater 3 via gears 8 and 9, a variable resistance 7 which rotates its axis by a gear 10 connected to the rotating gear 9 of the sheath heater 3 so as to change the value of the resistance 7, a door 11 for closing the heating chamber while the microwave oven is operated, an operating panel 12 including a key input means for controlling the operation of the microwave oven, a display 13 such as a liquid crystal display device or a fluorescent display tube, for displaying data from the key means or an operation condition of the microwave oven. The turntable 5 is operated to rotate itself when the heating is carried out.

Figure 2:
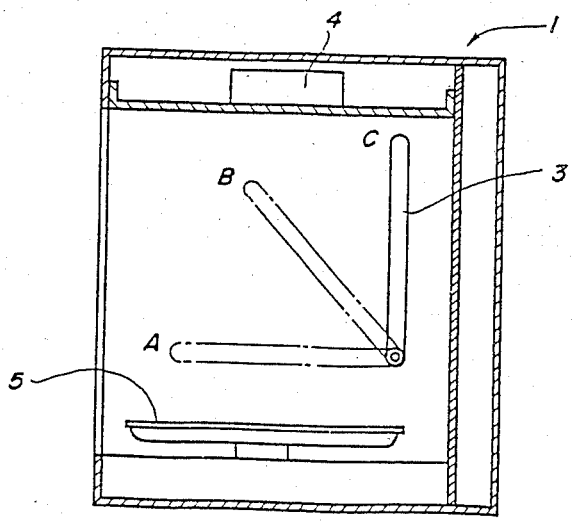
FIG. 2 shows a sectional view of a microwave oven having a movable heater taken along a line A—A of FIG. 1.

FIG. 2 shows a sectional view of a microwave oven according to an embodiment of the present invention taken along the ine A—A in FIG. 1. In FIG. 2, the set positions of the sheath heater 3 are shown when grill heating is performed.

Figure 3:
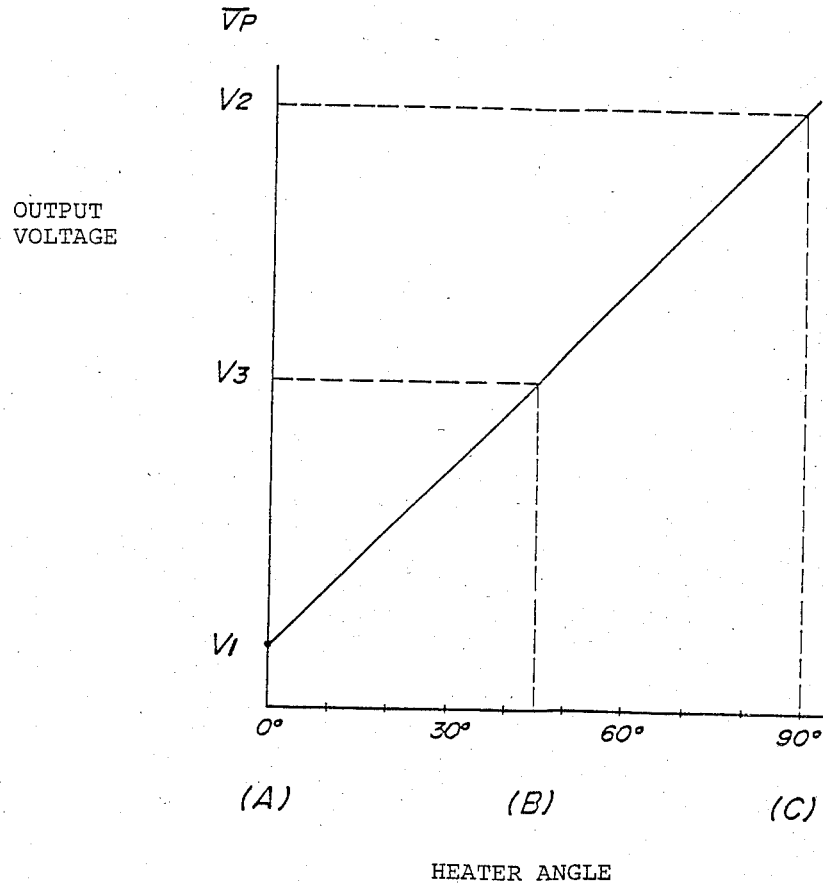
FIG. 3 shows a relationship between a heater angle and a output voltage of a variable resistance.

FIG. 3 shows a relationship between an output voltage $V_P$ of a slider of the variable resistance 7 when a direct current (DC) voltage ($V_C$) is applied across the the variable resistance 7 and each of heater positions (A), (B), and (C) in FIG. 2. According to the embodiment of the present invention, the heater 3 is selectively set at one of the three positions (A), (B), and (C). The heater position of the heater 3 should not be limited to the positions (A), (B), and (C) as illustrated. For example, the set position of the heater 3 are freely selected from a range between the positions (A) and (C).

When the sheath heater 3 is set at the position (A) (in other words, the angle between the heater 3 and the turntable 5 is about 0 degree), the sheathe heater 3 is parallel with the turntable 5. For example, the distance between them is about 5 cm. In this case, $V_P=V_1$.

When the position of the sheath heater 3 is at the position (B) (in other words, the angle between the sheath heater 3 and the turntable 5 is about 45 degrees), the distance between the top of the sheath heater 3 and the turntable 5 is about 15 cm. In this case, $V_P=V_3$.

When the position of the sheath heater 3 is at the position (C) (in other words, the angle between the sheath heater 3 and the turntable 5 is about 90 degrees), $V_P=V_2$. When the sheath heater 3 is positioned at the position (C) and driven, the oven heating such as the convention, a hot air circulating heating is carried out.

Figure 4:
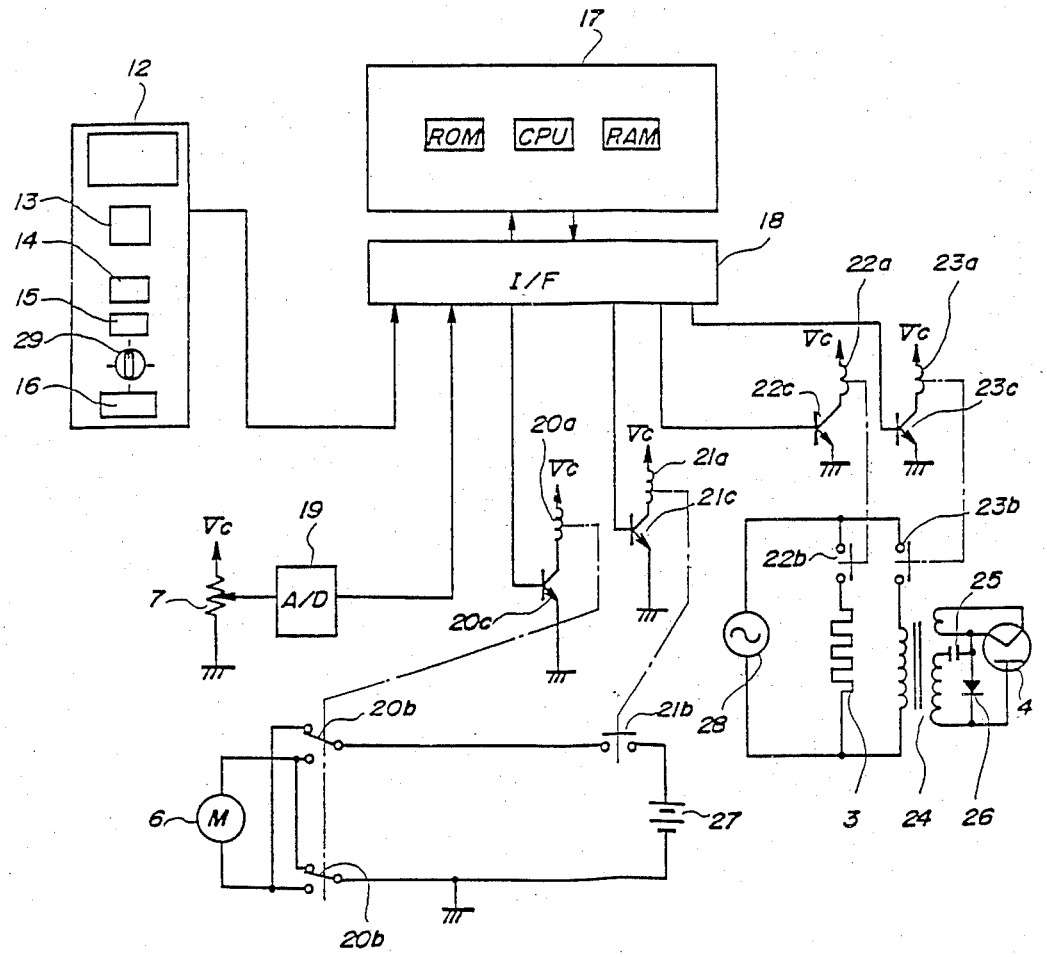
FIG. 4 shows a circuit diagram of a microwave oven having a movable heater according to an embodiment of the present invention.

FIG. 4 shows a circuit diagram of a microwave oven according to an embodiment of the present invention.

The operating panel 12 provided on the microwave oven includes a memory switch 13, a heater moving up switch 14, a heater lowering switch 15, a grill heating start switch 16. The memory switch 13 is operated to store or readout the positioning information of the heater 3. The heater moving up switch 14 is operated to move up the heater 3. The heater lower switch 15 is operated to lower the heater 3. The grill heating start switch 16 is operated to start the grill heating. The ON-OFF switching signals from these switches on the operating panel 12 are introduced and inputted into a microcomputer 17 through an interface 18. An output of the variable resistance 7 for detecting the position of the sheath heater 3 is applied to the microcomputer 17 through an anlog/digital (A/D) cover 19 and the interface 18.

A voltage from a DC power source 27 to the DC motor 6 for driving the sheath heater 3 is applied by switching a contact 21*b* of a relay 21*a* via a transistor 21*c* responsive to the output of the microcomputer 17.

The polarity of the applied voltage to the DC motor 6 is switched by a contact 20*b* of a relay 20*a* which is controlled through a transistor 20*c* responsive to the output of the microcomputer 17. The polarity of the applied voltage decides the rotating direction of the DC motor 6, namely, the moving direction of the sheath heater 3. The output voltage of the alternating current (AC) power source 28 is applied to the sheath heater 3 by switching a contact 22*b* of a relay 22*a* which is controlled thorugh a transistor 22*c* responsive to the output of the microcomputer 17, and applied to a driving circuit of the magnetron 4 by switching a contact 23*b* of a relay 23*a* which is controlled through a transistor 23*c* responsive to the output of the microcomputer 17.

The driving circuit of the magnetron 4 comprises a transformer 24, a capacitance 25, a rectifier 26. The components 24, 25, and 26 are connected to the magnetron 4 as shown in FIG. 4. $V_c$ designates a voltage from a control direct current (DC) power source.

A heating time setting button 29 is provided on the operating panel 12 for setting or selecting a heating period of time. The heating period set by the heating time setting button 29 is stored in a memory means (RAM) of the microcomputer 17 with the output of the variable resistance 7 detecting the position of the sheath heater 3 in response to the ON signal of the memory switch 13.

To operate the grill heating after the previous heating, if the user would like to select the heating period of time and the heating position of the sheath heater 3 of the previous heating, the data stored into the memory of the microcomputer 17 is read-out by switching on the memory switch 13, and applied to a control means for controlling the transistors 20*a*, 21*a*, 22*a*, and 23*a*.

Figure 5:
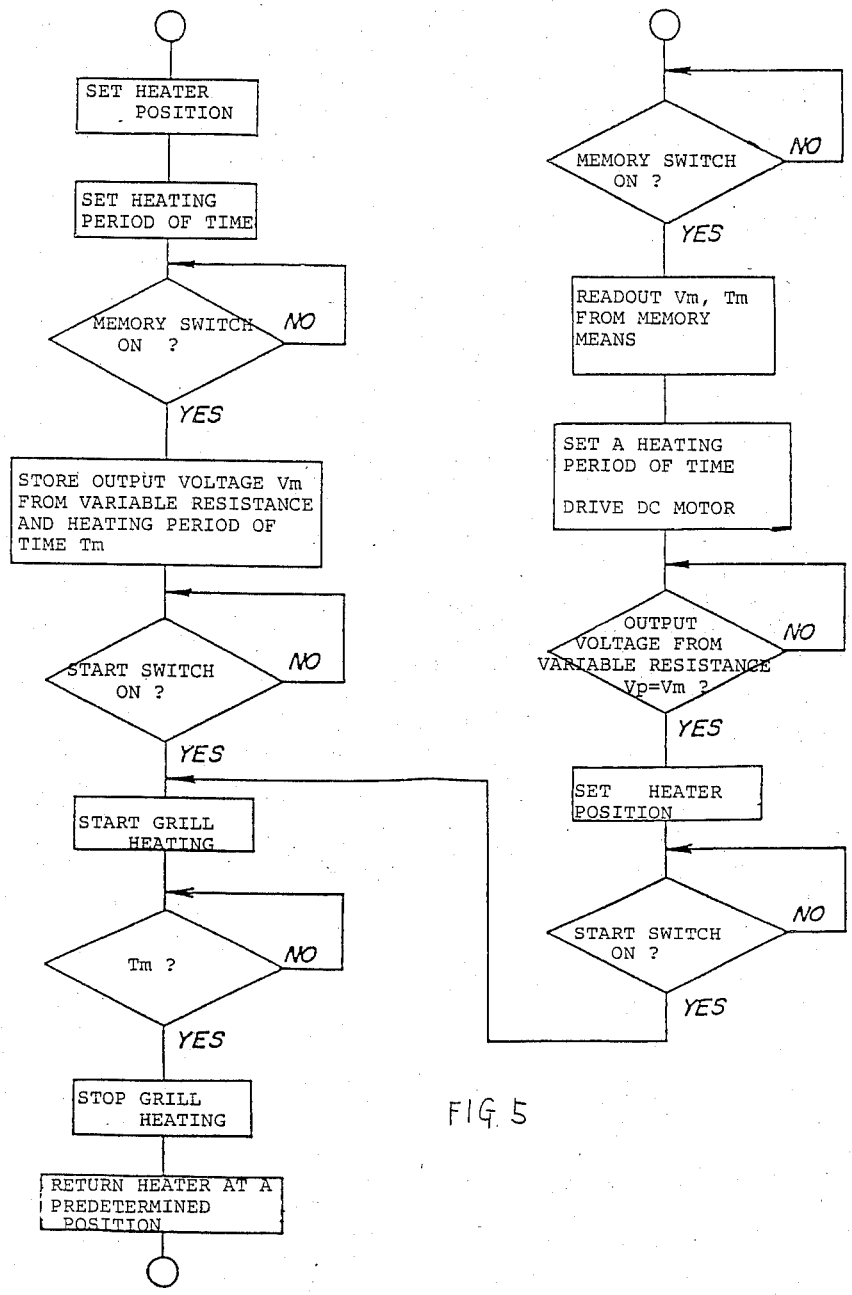
FIG. 5 shows a flow chart for explaining an operation of the microwave oven having a movable heater according to an embodiment of the present invention.

The grill heating operation will be described below. FIG. 5 shows a flowchart of an operation of the microwave oven having a movable heating means according to an embodiment of the present invention.

After a foodstuff to be cooked is disposed on the turntable 5 of the microwave oven 1, the sheath heater 3 is moved down from an initial position (C) by operating the heater lowering switch 15 of the operating panel 12 to set the sheath heater 3 on a satisfactory heating position. The satisfactory heating position is a position in which the foodstuff is beatifully browned by the heater.

The oven door 11 of the microwave oven 1 is closed. A heating period of time is set by the heating time setting button 29. The memory switch 13 is pressed to store the set position of the sheath heater 3 and the heating period of time into the memory of the microcomputer 17. As soon as the memory switch 13 turns on, the output voltage Vm from the variable resistance 7 for detecting the heater position is inputted into the microcomputer 17 through the A/D converter 19 and the interface 18. Therefore, the heater position data and the heating period of time are stored into the memory of the microcomputer 17. After storing the heating period of time and the heater position data, the grill heating start switch 16 is pressed to start the grill heating. When the grill heating is carried out till the heating period of time Tm, and is stopped, the sheath heater 3 is automatically returned from the setting position to the initial position (C).

In a case where the heater position and the heating period of time at the last heating are satisfied on a cooking completion and the last setting data are set also at the next heating, the memory switch 13 of the operating panel 12 is pressed and switched on after a foodstuff is put on the turntable 5 of the microwave oven 1. In this time, the heating period of time Tm and the output voltage Vm of the variable resistance 7 stored into the RAM of the microcomputer 17 are readout. The microcomputer 17 controls the contacts 20*b* and 21*b* of the relays 20*a* and 21*a* through the transistors 20*c* and 21*c* responsive to the readout data from the RAM. The DC motor 6 is driven responsive to the contacts 20*a* and 20*b*, and drives and moves the heater 3 so that the output voltage Vp of the variable resistance 7 becomes Vm from the RAM. Accordingly, the heater 3 is positioned at the last heater position.

In the heating period of time, since the last heating period of time is stored into the RAM of the microcomputer 17, the same grill heating as the last grill heating is carried out when the grill heating start switch 16 is pressed and switched on, if necessary, followed by selecting the heating time.

The heater position detecting means should not be limited to the variable resistance 7. For example, a potentiometer, a transformer, a photodiode, an encoder or other position transducer may be used.

Although the control means for the heater driving device compares the output voltage $V_P$ of the variable resistance 7 with the output voltage Vm stored into the memory means in the above embodiment, the control program for the heater driving device may be stored into the microcomputer 17.

The movable heater 3 should not be to the sheathe heater. Although, in the embodiment of the present invention, the heater position data such as the voltage from the variable resistance 7 is stored into or readout from the RAM with the heating period of time, at least one of the heater position data and the heating period of time may be stored and readout.

As described above, the heating apparatus of the present invention has a selectively movable heater for a grill heating and a convection heating and comprises heater position detecting means for detecting the heater position, memory means for storing a signal from the heater position detecting means, a memory switch for controlling the input and the output of the memory means, input means for inputting the signal from the heater position detecting means to the memory means responsive to the memory switch, output means for outputting the signal in the memory responsive to the memory switch, a heater driving device for moving the heater responsive to the output of the memory means, and control means for controlling the heater driving device. Accordingly, the heater position when grill heating is satisfied with a desired brown condition on the surface of foodstuff is stored into the memory by pressing and switching the memory switch. When the same menu is cooked at the next time, the data stored into the memory is readout by switching on the memory switch. The heater can be positioned at the same position based on the readout data. The microwave oven having a movable heater of the present invention enables a suitable heating with a simple operation.

In a grill heating operation, the microwave heating and the heater heating are carried out at the same time. The inside of foodstuff is heated by high frequency microwaves, and the surface of the foodstuff is beautifully browned.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A heating apparatus comprising:

a heating cavity;

selectively movable heater means for heating an object, said heater means being movable to a position within said heating cavity;

detection means for detecting the position of said heater means and producing a signal representative thereof;

memory means for storing the signal produced by said detecting means;

control means for introducing and recalling data, including said signal, from said memory means; and heater moving means, responsive to the position detected by said detection means and the data recalled from said memory means by said control means for selectively moving the heater means so as to set the heater means at a position defined by the signal output from the memory means.

2. The heating apparatus of claim 1, wherein the heating apparatus is a microwave oven.

3. A heating apparatus comprising:

a heating cavity;

selectively movable heater means for heating an object, said heater means being movable from a resting first position to a second position within said heating cavity;

a heater position setting device for setting the position of said heater means; said setting device including means for setting said movable heater to the second position from the resting first position;

means for detecting the second position of the movable heater;

means, responsive to said means for detecting, for storing the second position data representative of the position of the movable heater;

controlling means for controlling the input and the output of the storing means;

said means for setting moving the heater means to reposition said heater means at the second position in response to the second position data recalled by said controlling means from said means for storing.

4. A method for setting the position of a heater means within a cavity in a heating apparatus having a selectively movable heater means, the method comprising the steps of:

moving said heater means to a second position from a first resting position of said heater means;

detecting the second position of said heater means;

storing second position data in response to the detection of the position of the heater means by said step of detecting;

moving said heater means to the first position from the second position;

outputting the stored second position data; and setting said heater means at the second position in response to the second position data.

5. A heating appliance comprising:

a heating cavity;

a heating element;

element movement means for moving said heating element within said cavity;

control means for controlling heating operations within said heating cavity, said control means controlling said element movement means to position said heating element;

input means for introducing heating element movement commands into said control means, said control means controlling said element moving means to move said heating element to a desired position in response to said heating element movement command; and position detection means for detecting the position of said heating element;

said control means being responsive to the position detected by said position control means and being programmable, said control means including heating program storage means for storing a heating program representative of selected heating operations including storing said desired position of said heating element to facilitate repeatability of said selected heating operations;

said control means controlling said element movement means in response to said heating program to reposition said heating element at said desired position, said control means monitoring said position detected by said position detection means to control said element movement means.

6. The heating appliance of claim 5 wherein said appliance is a microwave oven.

7. The heating appliance of claim 5 wherein said control means is responsive to said position detection means to closed loop control said element movement means.

8. A heating appliance comprising:

a heating cavity;

control means for controlling heating operations within said heating cavity;

a heating element;

closed loop positioning means for positioning said heating element at a desired position within said heating cavity; said closed loop positioning means including;

element movement means for moving said heating element within said cavity, and position detection means for detecting the position of said element, said control means controlling said element movement means in response to the position detected by said position detection means to place said element at a desired said position.

9. The heating appliance of claim 8 wherein said control means is programmable and includes heating program storage means for storing a heating program representative of desired heating operations including storing the desired position of said heating element to facilitate repeatability of said desired heating operations, said control means being responsive to the position detected by said position detection means and storing said detected position in said heating program storage means when said detected position is said desired position.

* * * * *